US006689943B2

(12) United States Patent
McGuire, Jr. et al.

(10) Patent No.: US 6,689,943 B2
(45) Date of Patent: Feb. 10, 2004

(54) ACOUSTIC GUITAR WITH INTEGRAL PICKUP MOUNT

(75) Inventors: Michael D. McGuire, Jr., Mt. Juliet, TN (US); Matthew L. Klein, Hendersonville, TN (US)

(73) Assignee: Gibson Guitar Corp., Nashville, TN (US)

( * ) Notice: Subject to any disclaimer, the term of this patent is extended or adjusted under 35 U.S.C. 154(b) by 24 days.

(21) Appl. No.: 10/044,336

(22) Filed: Jan. 11, 2002

(65) Prior Publication Data

US 2002/0092403 A1 Jul. 18, 2002

Related U.S. Application Data

(60) Provisional application No. 60/262,313, filed on Jan. 17, 2001.

(51) Int. Cl.[7] ..... G10D 3/00

(52) U.S. Cl. ..... 84/291; 84/298; 84/299; 84/307; 84/723

(58) Field of Search ..... 84/291, 298, 299, 84/307, 192, 267, 723, 730

(56) References Cited

U.S. PATENT DOCUMENTS

| | | | | | |
|---|---|---|---|---|---|
| 455,221 | A | * | 6/1891 | Lorang | 84/298 |
| 474,432 | A | * | 5/1892 | Wolfram | 84/298 |
| 3,563,126 | A | * | 2/1971 | Connington | 84/298 |
| 4,418,599 | A | | 12/1983 | Raskin | 381/1.05 |
| 4,501,186 | A | | 2/1985 | Ikuma | 84/1.16 |
| 4,602,547 | A | | 7/1986 | Nyack, Jr. et al. | 84/1.15 |
| 4,741,238 | A | | 5/1988 | Carriveau | 84/291 |
| 4,867,027 | A | | 9/1989 | Barbera | 84/731 |
| 4,951,546 | A | | 8/1990 | Takabayashi et al. | 84/718 |
| 4,991,488 | A | | 2/1991 | Fala et al. | 84/731 |
| 5,204,487 | A | | 4/1993 | Turner | 84/731 |
| 5,305,675 | A | | 4/1994 | Lasner | 84/313 |
| 5,322,969 | A | | 6/1994 | Aaroe et al. | 84/731 |
| 5,455,381 | A | | 10/1995 | Juszkiewicz et al. | 84/731 |
| 5,602,353 | A | | 2/1997 | Juszkiewicz et al. | 84/298 |
| 5,686,677 | A | * | 11/1997 | Herbert | 84/307 |
| 5,877,447 | A | | 3/1999 | Vice | 84/730 |
| 5,895,872 | A | | 4/1999 | Chase | 84/291 |
| 5,929,360 | A | | 7/1999 | Szalay | 84/616 |
| 6,255,568 | B1 | | 7/2001 | Dunwoodie | 84/298 |

OTHER PUBLICATIONS

Picture of Gibson ES–336 Guitar.

* cited by examiner

*Primary Examiner*—Shih-Yung Hsieh
(74) *Attorney, Agent, or Firm*—Waddey & Patterson; Lucian Wayne Beavers

(57) ABSTRACT

A guitar is constructed to have a hollow body and to have a top member that has a pickup mounting portion integrally formed therein. A slot is cut into the pickup support area, and a pickup is received in the slot. Guitar strings are mounted on the guitar and stretched across the pickup which functions as a bridge to define the lower endpoint of the free length of the guitar strings.

21 Claims, 6 Drawing Sheets

ACOUSTIC GUITAR WITH INTEGRAL PICKUP MOUNT

This application claims benefit of co-pending provisional U.S. Pat. application Ser. No. 60/262,313 filed Jan. 17, 2001, entitled "Acoustic Guitar with Integral Pickup Mount" which is hereby incorporated by reference.

Be it known that we, Michael D. McGuire, Jr., a citizen of United States, residing in Nashville, Tenn., and Matthew L. Klein, a citizen of the United States, residing in Nashville, Tenn., have invented a new and useful "ACOUSTIC GUITAR WITH INTEGRAL PICKUP MOUNT".

BACKGROUND OF THE INVENTION

1. Field of the Invention

The present invention relates generally to the construction of guitars, and more particularly, but not by way of limitation, to a construction of an acoustic guitar having a size and shape similar to that of traditional solid body electric guitars.

2. Description of the Prior Art

In the traditional construction of acoustic guitars, there have been continuing efforts to add to the acoustic guitar an electrified pickup for sensing the motion or sound generated by the guitar string so that the same can be electronically amplified in a manner like that commonly done for solid body electric guitars.

There is generally a defining difference between guitars referred to as acoustic guitars and those referred to as solid body electric guitars. Acoustic guitars generally have a hollow body, and a significant factor in the sound produced is the acoustic property of the hollow body which acts as a sound chamber to generate acoustical energy. An example of a typical acoustic guitar would be a Gibson J-200 guitar.

One drawback of traditional acoustic guitars is the volume of sound produced from the guitar. Usually this volume is not significant enough to entertain large audiences, therefore a method by which to amplify this sound is required. This amplification has traditionally been accomplished through the use of an electronic pickup retrofitted onto traditional acoustic guitars. These electric pickups are retrofitted to electric guitars by adding electronic elements either over the sound hole in the acoustic guitars or attaching the elements to the bridge or sound board of the acoustic guitars. U.S. Pat. No. 4,501,186 issued to Ikuma shows a pickup device retrofitted onto an acoustic guitar by attaching an electromagnetic pickup over the sound hole of the acoustic guitar.

In fact, one problem with retrofitting acoustic guitars with electronic pickups is the additional elements weaken the guitar. Any additional elements added to the sound board of an acoustic guitar have the tendency to weaken the structure of the guitar. This occurs due to the additional stress on the sound board caused by the modifications to the sound board.

Another problem with retrofitting acoustic guitars with an electromagnetic pickup arises during the actual playing of the retrofitted acoustic guitar. Since the electromagnetic pickup is designed to receive, decipher, and amplify vibrations, a retrofitted acoustic guitar sends inconsistent signals to the electromagnetic pickup through the vibrations of not only the strings of the guitar, but also the resonance from the hollow body of the acoustic guitar. This causes an inconsistent amplification of the tones actually played from the instrument and the undesirable "feedback effect," which is unpleasant to any listener of an acoustic guitar retrofitted with an electromagnetic pickup.

The traditional hollow body acoustic guitar is a contrast to a solid body electric guitar, wherein the sound is primarily a function of the string vibration. This vibration is sensed by an electromagnetic pickup and then amplified to generate a sound of sufficient volume to be enjoyed by a large listening audience. An example of a traditional solid body electric guitar would be a Gibson Les Paul model guitar.

Traditional solid body electric guitars, while greatly reducing the above mentioned feedback effect, fail to achieve the same sound quality as hollow bodied acoustic guitars due to the lack of a hollow cavity to resonate the sound. While the traditional solid body electric guitar contains electromagnetic pickups easily adapted to interpret and amplify the vibrations from the strings of a solid body electric guitar, the traditional solid body electric guitar still requires that the bridge and the electromagnetic pickup are attached to the body of the solid body electric guitar after formation of the solid body. Once again this weakens the structure and integrity of the solid body electric guitar, while failing to produce the same quality of musical tones as the acoustic guitar.

Also, traditionally the electromagnetic pickup for an electric guitar comprises a plate shaped element attached to the top surface of the body of the traditional electric guitar. This plate shaped element lessens the visual appeal of the guitar.

There is a third category of guitars, known as semi-hollow body guitars, which utilize conventional electric guitar pickups on a body that is typically thinner than a conventional acoustic guitar, but which still contains a marginally hollow core. An example of a semi-hollow body instrument would be the Gibson ES-335 guitar.

One type of pickup that has previously been used with acoustic guitars is a piezoelectric pickup such as the model LB6 series pickup manufactured by the LR Baggs Co. These piezoelectric pickups are constructed to function as the bridge across which the guitar strings are supported. The guitar strings press down upon the pickup and as the strings vibrate the changing pressure on the pickup generates a changing electrical signal in a piezoelectric element that is a part of the pickup. Pickups of this type are typically mounted in a separate bridge support member that is glued onto or screwed onto the top surface of the guitar body. That separate bridge support has a slot milled therein for receipt of the piezoelectric transducer element.

Thus, there is a continuing need for improvements in the construction of pickups and the mounting thereof for use with hollow body guitars.

SUMMARY OF THE INVENTION

The present invention provides a stringed musical instrument comprising an instrument top that includes a sound board and an integral bridge extending from the sound board. The bridge is designed to space the strings of the musical instrument from the sound board. The instrument includes a slot within the bridge, which is designed to contain a piezoelectric pickup. The instrument also includes a hollow body.

The present invention also teaches a stringed guitar comprising a hollow, completely enclosed sound box that is lacking a sound hole. This stringed guitar also includes a sound board and an integral bridge as part of the sound box. Also received within the integral bridge is a piezoelectric pickup.

A method for constructing the body of a stringed musical instrument is also disclosed. The method comprises providing a solid block of material and shaping that solid block of material to form a sound board and an integral extension of the sound board. The extension is adapted to space the strings of the musical instrument from the sound board.

This construction results in a guitar of unique appearance and improved function. The integral construction of the slot for receipt of the piezoelectric pickup eliminates the need for gluing or fastening a separate bridge support member onto the body of the guitar.

Accordingly, it is a general object of the present invention to provide an improved construction for acoustic guitars.

Also, it is an objective of the present invention to provide a stringed musical instrument with a sound board and integral bridge extending from the sound board.

Another objective of the present invention is to provide an electric guitar is a substantially hollow body.

Still another object of the present invention is to provide a hollow body guitar that is lacking a sound hole by which acoustic energy can emanate.

Yet another object of the present invention is to provide a method for constructing the body of a stringed musical instrument wherein the method includes shaping a solid block of material into a sound board and an integral extension of the sound board, the extension designed to space the strings of the musical instrument from the sound board.

Another object of the present invention is to provide an improved construction for the mounting of a piezoelectric pickup in a guitar.

Still another object of the present invention is the provisional of novel appearance for a guitar.

Other and further objects features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
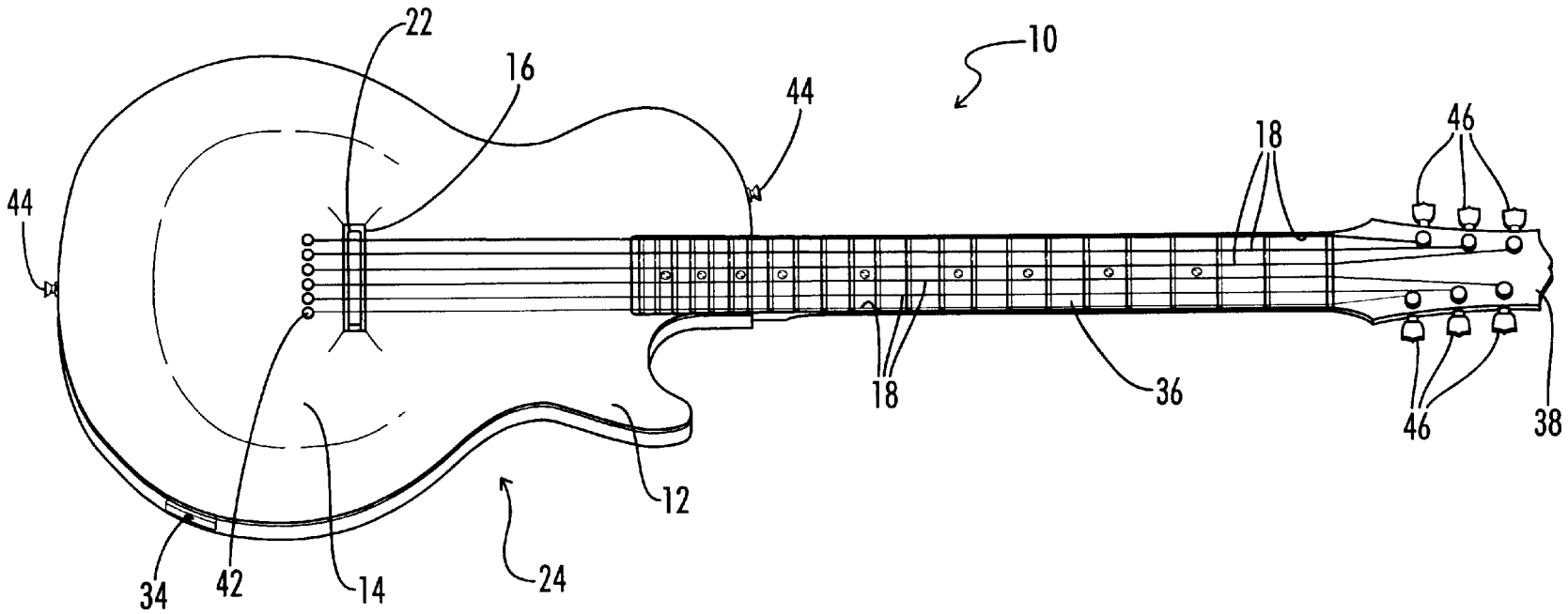
FIG. 1 is a top perspective view of a guitar constructed in accordance with the present invention.

Referring now to FIG. 1, the stringed musical instrument, such as an electric guitar, of the present invention is shown and is generally designated by the numeral 10. The stringed musical instrument 10 comprises an instrument top 12, which includes a sound board 14 and an integral bridge 16 extending from the sound board 14. The integral bridge 16 is designed to space the strings 18 of the musical instrument 10 from the sound board 14.

Figure 5:
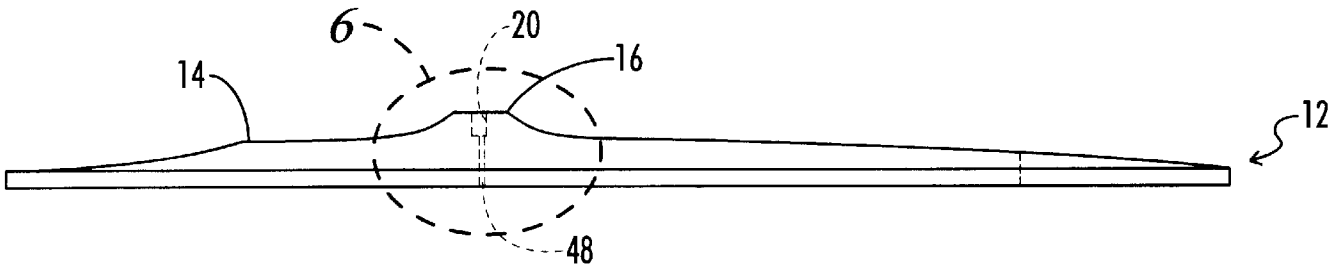
FIG. 5 is a side view of the instrument top that comprises the sound board and the integral bridge.
Figure 6:
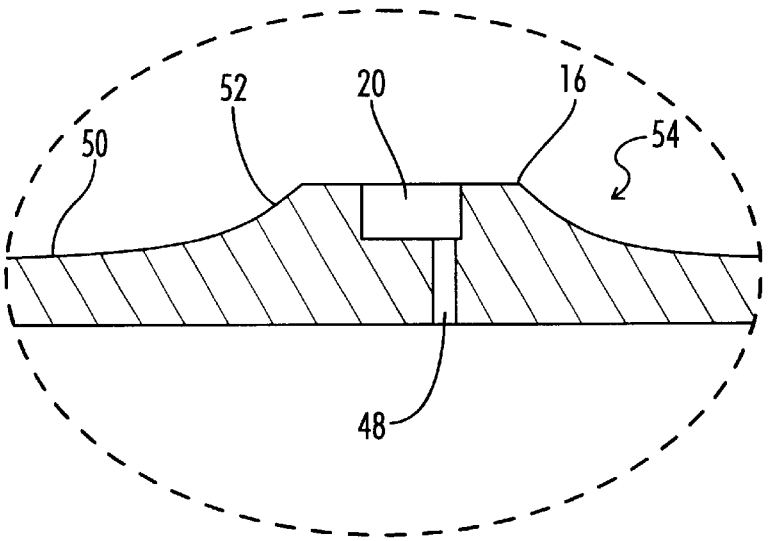
FIG. 6 is a detailed view of a cross sectional area of the integral bridge located on the instrument top.

As seen in FIGS. 5 and 6, the integral bridge 16 includes a slot 20 defined within the integral bridge 16. Also, the musical instrument 10 further includes a piezoelectric pickup 22 positioned in the slot 20, as seen in FIG. 8.

The instrument top 12, comprised of the sound board 14 and the integral bridge 16, is constructed to form a seamless connection between the sound board 14 and the integral bridge 16. The seamless connection can also be described as a connection not having a line of separation between the sound board 14 and the bridge 16. It is this seamless connection between the sound board 14 and the integral bridge 16 that strengthens the structural integrity of the instrument top 12.

Instrument 10 further includes a guitar back 56. The guitar back 56 and instrument top 12 together form a guitar body 24 which may also be referred to as a sound box 24.

Figure 4:
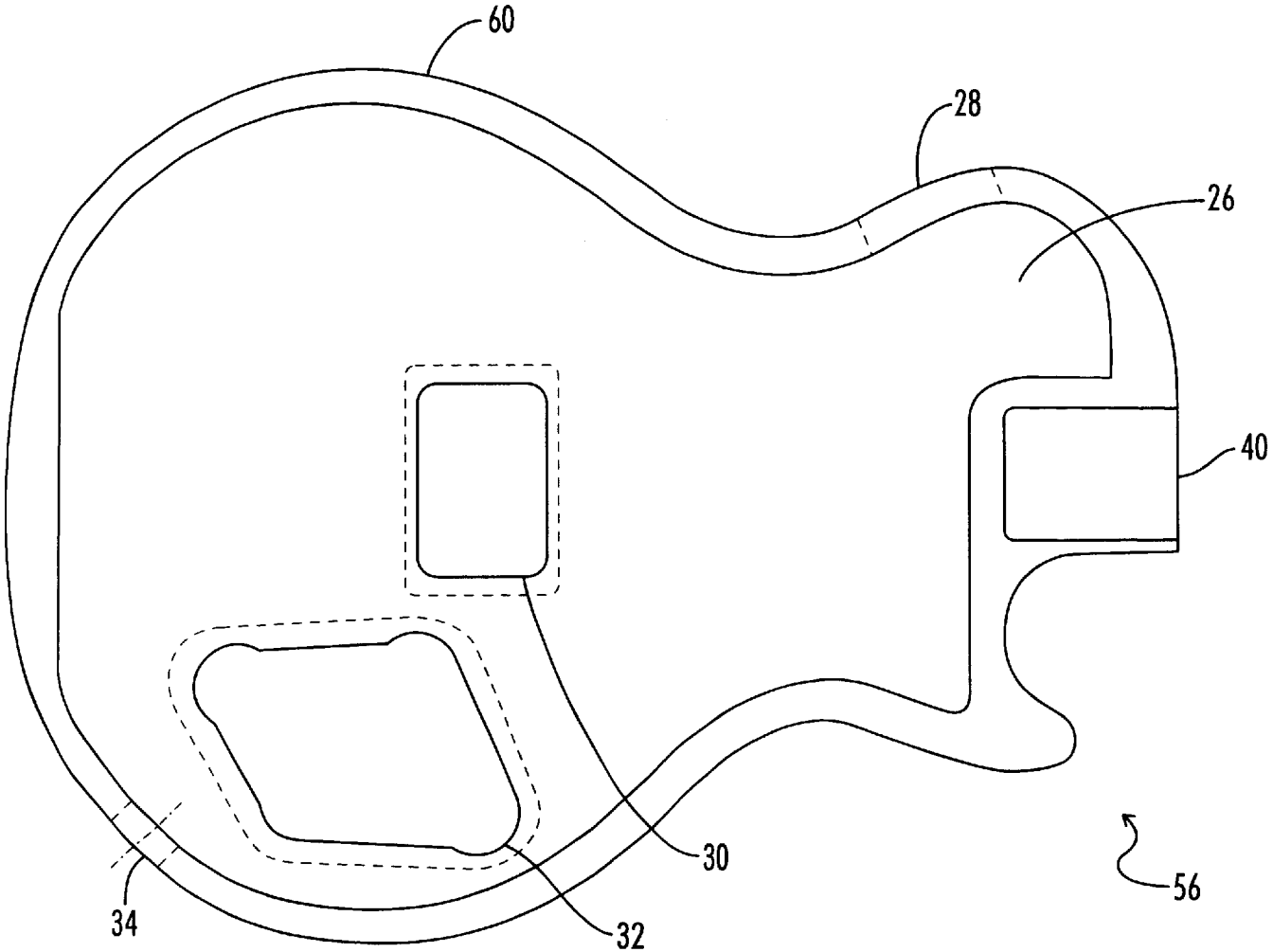
FIG. 4 is a top view of the guitar back of the body of the guitar constructed in accordance with the present invention that has the instrument top or sound board removed from the guitar back. This shows the hollow cavity within the body of the guitar.
Figure 7:
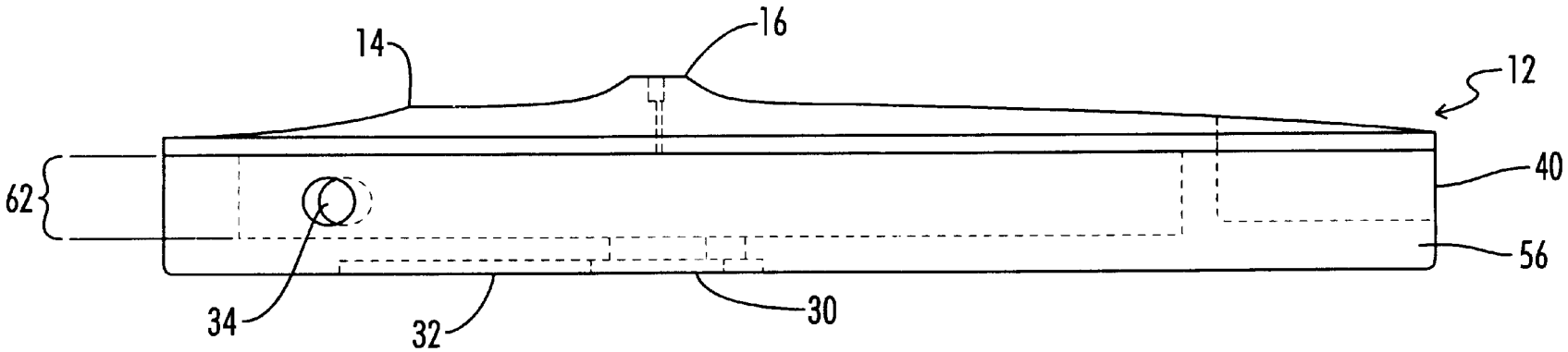
FIG. 7 is a side view of the guitar body.

FIG. 4 shows the hollow center 26 of the guitar back 56. The perimeter 60 of the body 24 is shown. In FIG. 7, the depth of the hollow center 26 of guitar back 56 is indicated as 62.

In a preferred embodiment, the body 24 is made from two different elements. The first element, the guitar back 56, composed of mahogany wood, is hollowed out. Then the second element, the instrument top 12, which is a maple cap, is adhered onto the mahogany wood. The perimeter shape 60 is then cut. The outer dimensions of the guitar body 24 are substantially similar to that of a standard Gibson Les Paul model guitar. At the same time the perimeter shape 60 is cut, the battery pocket 30 and access pocket 32 are routed in the guitar back 56.

The second element, the instrument top 12 comprised of an integral bridge 16 and the sound board 14, starts out as a single piece of maple wood. The integral bridge 16 is carved to a specific height in order to attain the correct saddle height. Then the sound board portion 14 is carved to the desired height. The seamless outer transitional surface 54 is then sanded and blended between the integral bridge 16 and the sound board 14 in order to create the seamless connection between the integral bridge 16 and the sound board 14. This results in an integral bridge 16 that eliminates the problems encountered with a conventional mounting system for an electromagnetic pickup. Namely, this eliminates the need for a separate pickup support piece that is typically glued or screwed onto the top of the guitar 10. In a preferred embodiment, the instrument top 12 is composed of carved maple wood, and the entire guitar is 3–¾" thick.

The instrument top 12 can be described as being part of the body 24 of the musical instrument 10. The body 24 includes the hollow center 26, as seen in FIG. 4. In a preferred embodiment, the hollow center 26 preferably comprises between 40 to 50% of the volume of the body 24 of the musical instrument 10, and most preferably the hollow center 26 comprises about 45% of the volume of the body 24 of the musical instrument 10.

As seen in FIG. 4, the guitar back 56 includes a control opening 28 which houses the tone and volume controls for the electrical aspects of the musical instrument 10. The guitar back 56 also includes battery pocket 30 and access pocket 32 located in the portion of the guitar back 56 opposite the instrument top 12. Also seen in FIG. 4 is the output jack 34 that provides a conduit for the electrical signals from the piezoelectric pickup 22 to reach an amplifier (not shown). The guitar back 56 also includes two connection pins 44 used to attach a guitar strap (not shown) to the musical instrument 10 in order for a user (not shown) to carry and control the musical instrument 10.

Figure 2:
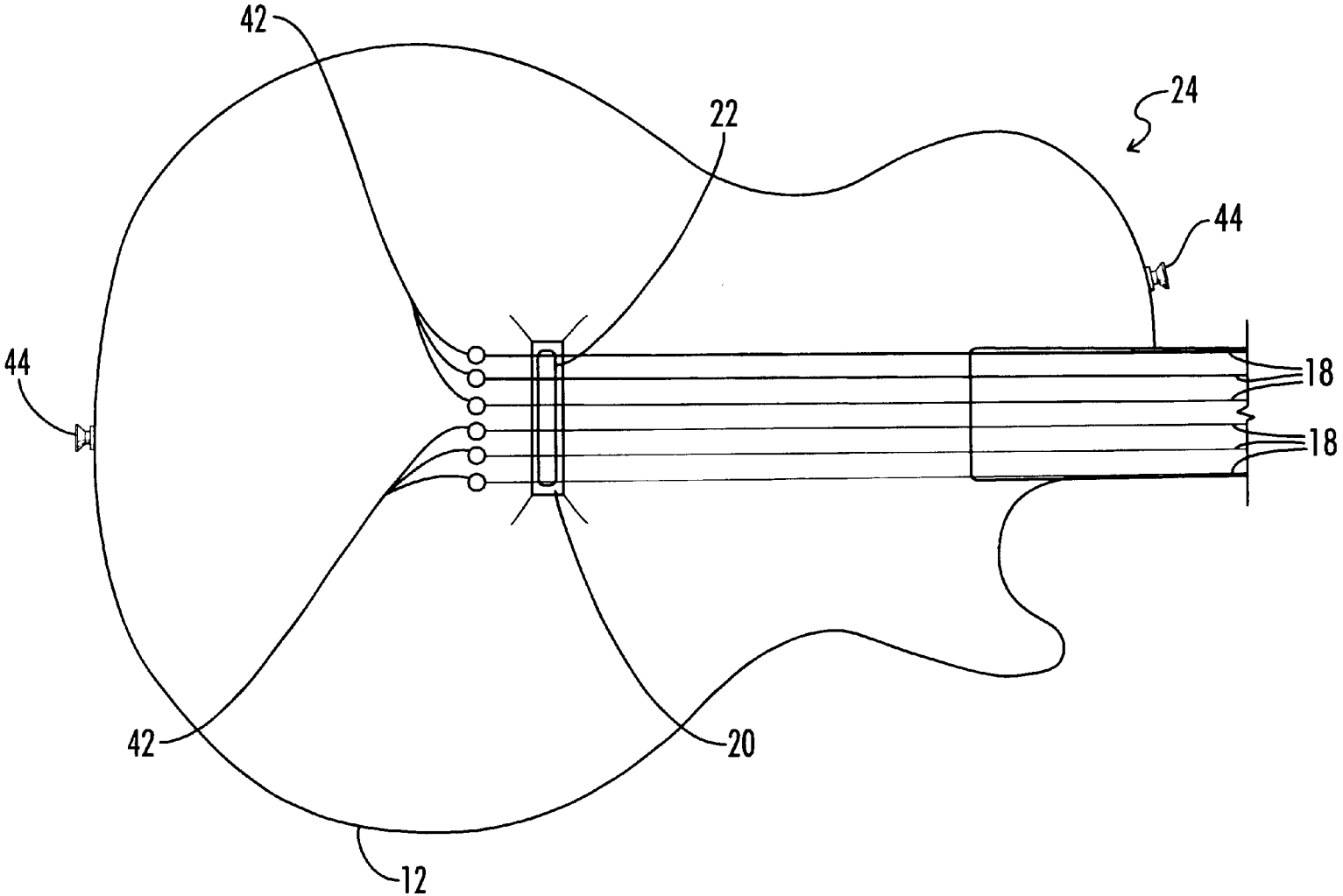
FIG. 2 is a top view of the body of a guitar constructed in accordance with the present invention.
Figure 3:
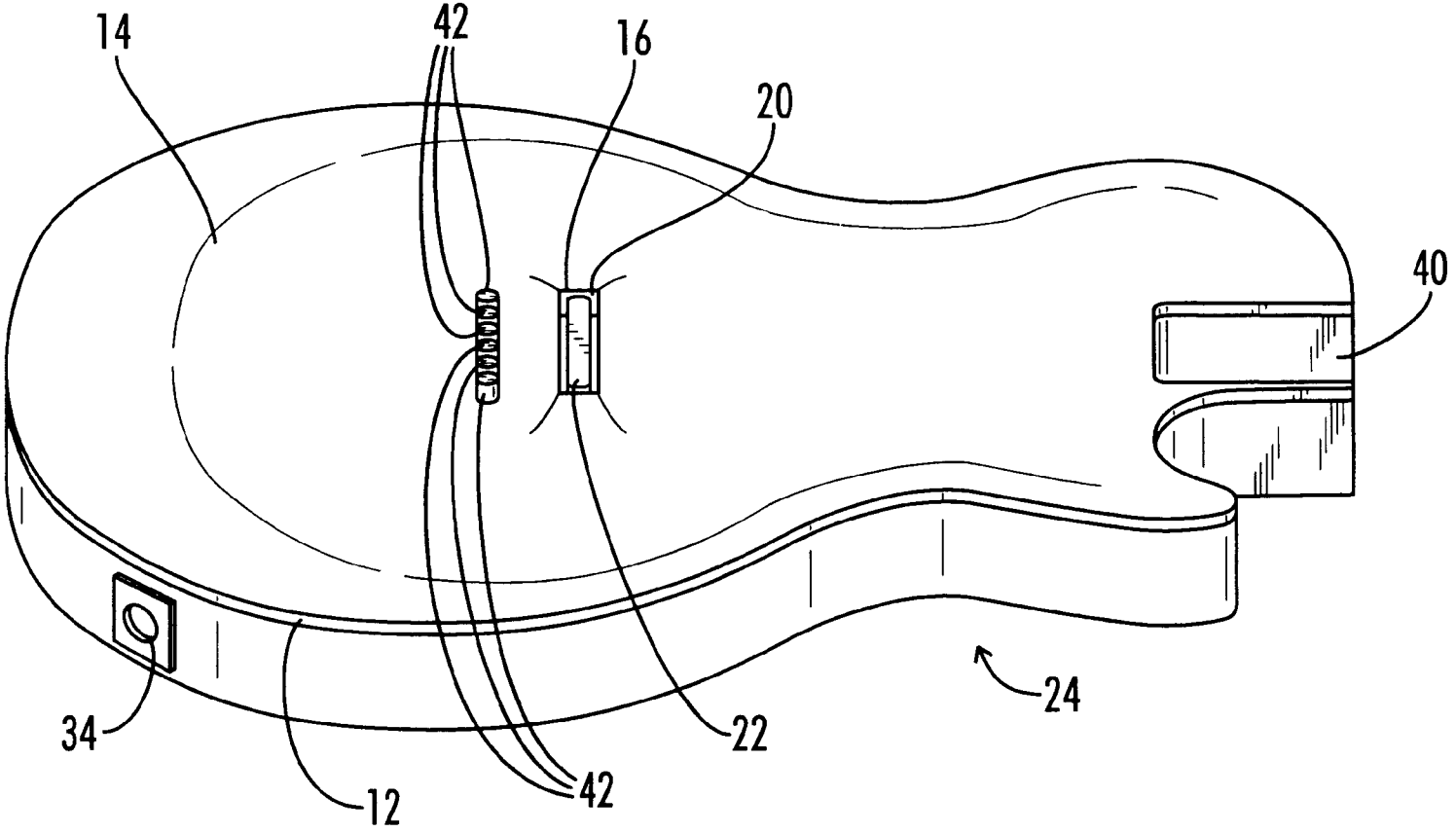
FIG. 3 is a perspective view of the body of guitar constructed in accordance with the present invention.

In a preferred embodiment of the invention, the instrument top 12 is closed so that there is no sound hole communicated with the hollow center 26 of the body 24. As seen in FIG. 2, the instrument top 12 lacks an opening of any significant area through which acoustical energy travels in order to transmit or amplify sound from the hollow center 26 of the body 24. In the alternative, this feature of the current invention can also be described as comprising a hollow, completely enclosed sound box 24, which lacks a sound hole.

The musical instrument 10, as seen in FIG. 1, includes a neck 36 engaging the body 24 and a headstock 38 engaging the neck 36. The musical instrument 10 also includes strings 18 which engage the headstock 38 and the instrument top 12. The strings 18 also span the entire length of the neck 36. The integral bridge 16 is positioned on the sound board 14 proximate to the engagement of the strings 18 of the musical instrument 10 and the sound board 14. As seen in FIG. 4, the guitar back 56 contains neck connection opening 40 that allows the neck 36 to engage the body 24 of the musical instrument 10.

The strings 18 of the musical instrument 10 engage the sound board 14 of the instrument top 12 through the use of six ebony bridge pins 42. Each of the bridge pins 42 fix one of the six strings 18 to the sounding board 14. The location of fixation of the strings 18 to the sounding board 14 is such that the piezoelectric pickup 22 located in the slot 20 of the integral bridge 16 is positioned between the neck 36 and the bridge pins 42.

The strings 18 of the musical instrument 10 specifically engage tuning heads 46 located on the headstock 38. The tuning heads 46 allow adjustment of the tension on the strings 18 thereby affecting the tone of the musical instrument 10. As seen in FIG. 6, access channel 48 connects slot 20 with the hollow center 26 of the body 24. Access channel 48 allows the physical connection of the conduction card from the piezoelectric pickup 22 to the output jack 34 and tone and volume controls of the musical instrument 10.

The sound board 14 of the electric guitar 10 includes a top surface 50 and the seamless extension 16 includes an outer surface 52. The electric guitar 10 is constructed so that the top surface 50 of the sound board 14 smoothly blends into the outer surface 52 of the seamless extension 16.

The current invention also teaches a method for constructing the body 24 of a stringed musical instrument 10. The method comprises providing a solid block of material (not shown), wherein the solid block includes first and second wooden pieces (not shown) adhered together to form the solid block. The method further includes the shaping of the solid block of material to form the sound board 14, and integral bridge 16. The method also includes shaping the seamless outer transitional surface 54. The seamless outer transitional surface 54 connects the soundboard 14 and the integral bridge 16 as seen in FIG. 6. The method also includes forming a slot 20 in the integral bridge 16.

Furthermore, this construction provides a very unique appearance for the guitar as illustrated in the drawings.

In a preferred embodiment the piezoelectric pickup 22 is the LB6 series manufactured by LR Baggs Company. The LB6 series piezoelectric pickup is unique in several ways. First of all, the pickup itself is a saddle that has six individual sensors cast right into it. Maximum sensitivity and signal conductivity is obtained since the sensors are an integral part of the connection between the strings 18 and the guitar 10 body. Second, the sensors themselves are responsive to vibration as well as to pressure. This blends the natural warmth of the body vibrations with the presence and attack of the strings 10. This increases the sound quality and functionality of the piezoelectric pickup 22.

The piezoelectric pickup 22 is further enhanced by its location within the integral bridge 16 that is part of the instrument top 12 that is part of the body 24 of the musical instrument 10. The LB6 also contains a feedback inhibiting circuit that enhances the musical qualities and listening enjoyment of the tones emanating from the musical instrument 10. The piezoelectric pickup 22 is powered by a 9-volt battery (not shown) that facilitates the transfer of acoustical energy into electromagnetic form.

Thus, it is seen that the present invention readily achieves the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A stringed musical instrument comprising:

an instrument top including a sound board and an integral bridge extending from the sound board, the bridge operatively adapted to space the strings of the musical instrument from the sound board, wherein the sound board and the bridge form a continuous instrument top, the bridge including an outer surface that smoothly blends into the sound board.

2. The instrument of claim 1, wherein:

the bridge includes a slot defined therein; and the instrument further includes a piezoelectric pickup positioned in the slot.

3. The instrument of claim 1, wherein the sound board and the bridge are constructed to form a seamless connection between the sound board and the bridge.

4. The instrument of claim 1, further comprising a body including a hollow center, the instrument top being a part of the body.

5. The instrument of claim 4, wherein between forty to fifty percent of the body is hollow.

6. The instrument of claim 4, wherein the instrument top is closed so that there is no sound hole communicated with the hollow center of the body.

7. The instrument of claim 4, further comprising:

a neck engaging the body, the neck having a length;

a headstock engaging the neck;

wherein the strings of the musical instrument engage the headstock and the instrument top and span the entire length of the neck; and wherein the bridge is positioned on the sound board proximate to the engagement of the strings of the musical instrument and the sound board.

8. A stringed guitar comprising a hollow completely enclosed sound box which is lacking a sound hole, the sound box including a sound board and an integral bridge, the bridge including an outer surface that smoothly blends into the sound board of the sound box.

9. The guitar of claim 8, wherein between forty to fifty percent of the sound box is hollow.

10. The guitar of claim 8, wherein, the bridge is adapted to operatively space the strings of the guitar from the sound board.

11. The instrument of claim 10, further comprising a slot defined within the bridge and a piezoelectric pickup received in the slot.

12. The instrument of claim 10, wherein the sound board and the bridge are constructed to form a seamless connection.

13. An electrical guitar comprising:

a hollow body including a sound board and an extension wherein the sound board includes a top surface and the extension includes an outer surface which smoothly blends into the top surface of the sound board;

a slot defined within in the seamless extension; and a piezoelectric pickup positioned within the slot.

14. The electric guitar of claim 13, wherein the body includes a hollow cavity which comprises between forty to fifty percent of the volume of the body.

15. The electric guitar of claim 13, further comprising:

a plurality of strings engaging the sound board proximate to the position of the extension on the sound board; and wherein the piezoelectric pickup engages the strings to operatively space the strings from the sound board.

16. A method for constructing the body of a stringed musical instrument, the method comprising:

a) providing a solid block of material; and b) shaping the solid block of material to form a sound board and an integral extension of the sound board, the extension smoothly extending away from the sound board and adapted to space the strings of the musical instrument from the sound board.

17. The method of claim 16, wherein in step (a) the solid block includes first and second wooden pieces adhered together to form the solid block.

18. The method of claim 16, wherein step b) includes shaping a seamless outer transitional surface between the sound board and the extension.

19. The method of claim 16, wherein step b) includes forming a slot in the extension.

20. A method for constructing the top of the body of an electric guitar, the method comprising:

a) providing a solid block of wood; and b) carving the solid block of wood to form a sound board and an integral bridge smoothly extending from the sound board.

21. A method for constructing the body of an electric guitar, the method comprising:

a) providing first and second solid pieces of wood;

b) carving the first piece of wood to form a sound board and an integral bridge extending from the sound board so that the bridge smoothly blends into the sound board;

c) carving the second piece of wood to form a guitar back; and d) attaching the sound board to the guitar back to form a guitar body which is between forty to fifty percent hollow and which has no soundhole opening.

* * * * *